US008262437B2

(12) United States Patent
Moon et al.

(10) Patent No.: US 8,262,437 B2
(45) Date of Patent: Sep. 11, 2012

(54) GLASS POLISHING SYSTEM

(75) Inventors: Won-Jae Moon, Seoul (KR); Sang-Oeb Na, Seoul (KR); Hyung-Young Oh, Goyang-si (KR); Yang-Han Kim, Goyang-si (KR); Young-Sik Kim, Seoul (KR); Kil-Ho Kim, Suwon-si (KR); Heui-Joon Park, Incheon (KR); Chang-Hee Lee, Osan-si (KR)

(73) Assignee: LG Chem Ltd., Seoul (KR)

( * ) Notice: Subject to any disclaimer, the term of this patent is extended or adjusted under 35 U.S.C. 154(b) by 424 days.

(21) Appl. No.: 12/718,785

(22) Filed: Mar. 5, 2010

(65) Prior Publication Data

US 2010/0227537 A1 Sep. 9, 2010

(30) Foreign Application Priority Data

Mar. 6, 2009 (KR) ..... 10-2009-0019293

(51) Int. Cl.
*B24B 7/24* (2006.01)
*B24B 57/02* (2006.01)

(52) U.S. Cl. ..... 451/317; 451/388; 451/398; 451/446

(58) Field of Classification Search ..... 451/317, 451/388, 397, 398, 446, 59
See application file for complete search history.

(56) References Cited

U.S. PATENT DOCUMENTS 4,272,924 A * 6/1981 Masuko et al. ..... 451/1
4,627,195 A * 12/1986 Greenleaf ..... 451/270
5,931,722 A * 8/1999 Ohmi et al. ..... 451/271
6,136,138 A * 10/2000 Yagisawa ..... 156/345.12
6,179,695 B1 * 1/2001 Takahashi et al. ..... 451/287
6,299,506 B2 * 10/2001 Nishimura et al. ..... 451/8

* cited by examiner

*Primary Examiner* — Dung Van Nguyen
(74) *Attorney, Agent, or Firm* — McKenna Long & Aldridge LLP

(57) ABSTRACT

A glass polishing system includes a lower unit capable of rotating a glass placed at a fixed position, an upper unit capable of contacting with the glass and being passively rotated due to the rotation of the glass, and a moving unit for moving the upper unit in a horizontal and/or vertical direction. The upper unit includes a platter installed to a spindle of the moving unit, a separative platter separatably installed to the platter and having a polishing pad contacting with the glass, and a vacuum chuck for fixing the separative platter with respect to the platter by means of vacuum.

18 Claims, 3 Drawing Sheets

GLASS POLISHING SYSTEM

CROSS-REFERENCE TO RELATED APPLICATION

This application claims priority under 35 USC 119(a) to Korean Patent Application No. 10-2009-0019293 filed in Republic of Korea on Mar. 6, 2009, the entire contents of which are incorporated herein by reference.

BACKGROUND OF THE INVENTION

1. Field of the Invention

The present invention relates to a glass polishing system, and more particularly to a glass polishing system for polishing one surface of a glass used in a liquid crystal display.

2. Description of the Related Art

Generally, it is very important that a glass (or, a glass pane) applied to a liquid crystal display keeps its flatness to a certain level so as to accurately realize images. Thus, fine waviness existing on a surface of a float glass formed through a float chamber should be removed.

Such a glass polishing process may be classified into so-called 'Oscar' type polishing in which glasses are individually polished one by one, and so-called 'inline' type polishing in which a series of glasses are successively polished. Also, the glass polishing process may be classified into 'single side polishing' in which only one surface of a glass is polished, and 'double side polishing' in which both surfaces of a glass are polished.

In a conventional glass polishing device, while a polishing plate (or, a top board) having a polishing pad installed thereto is moved in a horizontal direction and a polishing stage (or, a bottom board) having a glass located thereon is rotated, the glass is polished using a polishing slurry freely falling down onto the polishing plate.

However, in the conventional polishing process, a certain pressure is formed between the glass and the polishing plate. In this reason, the polishing slurry cannot sufficiently permeate through grooves formed in the polishing plate, so it is not easy to stably and uniformly supply the polishing slurry. In addition, in the conventional polishing device, while being supplied, the polishing slurry may unnecessarily flow down out of the polishing plate, which makes it difficult to uniformly polish the glass.

Meanwhile, the conventional glass polishing device gives a force to a glass due to the weight of the top board, or the polishing plate, itself, so it is impossible to apply uniform force to the glass over the entire area of the polishing plate. Thus, a finally polished glass has irregular flatness at every region of the rectangular glass, which results in many defective products. In particular, this problem becomes more serious as a size of the polishing plate is increased (e.g., about 1,000 mm in diameter) due to the increase of a size of a liquid crystal display. In detail, in the conventional glass polishing device, the polishing plate contacting with a glass is substantially not able to give uniform force to the glass at every region, and the force applied to the glass is decreased as being distanced from a spindle to which the polishing plate is installed, so uniform polishing is impossible.

In addition, as the polishing plate has a larger size, the maintenance or exchange of the polishing pad attached to the polishing plate of the conventional polishing device becomes more difficult, needs more equipment and consumes more time.

SUMMARY OF THE INVENTION

The present invention is designed to solve the problems of the prior art, and an object of the present invention is as follows.

First, the present invention is directed to providing a glass polishing system allowing easy maintenance or exchange of a polishing pad by keeping the separative platter having a polishing pad to be attached by absorption to the middle platter.

Second, the present invention is directed to providing a glass polishing system capable of increasing the flatness of a glass by separating the upper unit into a fixed platter and a polishing platter (including a middle platter and a separative platter) movable or floatable with respect to the fixed platter, installing a plurality of pressing members such as air springs between the fixed platter and the polishing platter, and then making the glass be uniformly pressed at several portions of the upper unit during a polishing work and also making the air springs absorb vibrations generated during the polishing process.

Third, the present invention is directed to providing a glass polishing system capable of improving the efficiency of a polishing slurry supplying work by directly supplying a polishing slurry to a surface of a glass through a plurality of polishing slurry supply paths formed through an upper unit (including a fixed platter, a middle platter and a separative platter) to which a polishing pad is installed.

In order to accomplish the above object, the present invention provides a glass polishing system, which includes a lower unit capable of rotating a glass placed at a fixed position; an upper unit capable of contacting with the glass and being passively rotated due to the rotation of the glass; and a moving unit for moving the upper unit in a horizontal and/or vertical direction, wherein the upper unit includes a platter installed to a spindle of the moving unit; a separative platter separatably installed to the platter and having a polishing pad contacting with the glass; and a vacuum chuck for fixing the separative platter with respect to the platter by means of vacuum.

Preferably, the vacuum chuck includes a plurality of compressing channels installed through the fixed platter and the platter; and a vacuum unit for forming a vacuum on a surface of the platter, contacted with the separative platter, so as to be communicated with the compressing channels.

Preferably, there are provided at least two vacuum chucks concentrically arranged based on the spindle.

Preferably, the vacuum unit includes an integrated stepped surface formed by depressing a lower surface of the platter.

Preferably, the vacuum unit includes a plurality of flared vacuum grooves formed in a lower surface of the platter such that the grooves have an increased size from the compressing channels.

Preferably, the glass polishing system according to the present invention further includes a safety coupling member for detachably attaching the separative platter to the platter.

Preferably, the safety coupling member includes a plurality of brackets provided at rims of the platter and the separative platter, and a locking unit for locking the brackets.

Preferably, the safety coupling member includes a plurality of coupling bolts fixed to the separative platter through the platter, and covers for covering the coupling bolts, respectively.

Preferably, the platter includes a fixed patter fixed to the spindle; a middle platter installed movably with respect to the fixed platter, the separative platter being attached to the middle platter, and a pressing member interposed between the fixed platter and the middle platter to keep a uniformity of pressure of the upper unit, applied to the glass.

Preferably, the pressing member includes a plurality of air springs installed between the fixed platter and the middle platter.

Preferably, the air springs include at least one air spring group arranged in a circular pattern based on the spindle.

Preferably, every air spring included in the same air spring group is kept at the same pressure.

Preferably, a pressure applied to each of the air springs is adjustable.

Preferably, each of the air springs includes a bellows with an air inlet so as to suck in an air supplied through the fixed platter.

Preferably, the glass polishing system according to the present invention further includes a plurality of guide members installed between the fixed platter and the middle platter so as to guide the movement of the middle platter with respect to the fixed platter.

Preferably, each of the guide members includes a guide shaft installed to the middle platter through the fixed platter; and a guide stopper installed at the other end of the guide shaft.

Preferably, the glass polishing system according to the present invention further includes a polishing slurry supply unit for supplying a polishing slurry to the glass through the platter and the separative platter.

Preferably, the polishing slurry supply unit includes a plurality of polishing slurry supply paths installed through the platter and the separative platter.

The glass polishing system according to the present invention gives the following effects.

First, the separative platter having a polishing pad installed thereto may be selectively separated from the middle platter in an absorption manner, so the maintenance or exchange of the polishing pad is easy.

Second, a plurality of air springs allow giving the same force to several portions of the polishing platter with respect to the fixed platter and also absorb vibrations occurring during a polishing work, so it is possible to improve the flatness of a glass produced.

Third, a polishing slurry may be directly supplied to the surface of a glass through polishing slurry supply paths respectively formed through a fixed platter, a middle platter and a separative platter, so it is possible to maximize the efficiency of a polishing slurry supply work and ensure stable and uniform supply of the polishing slurry.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings.

Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
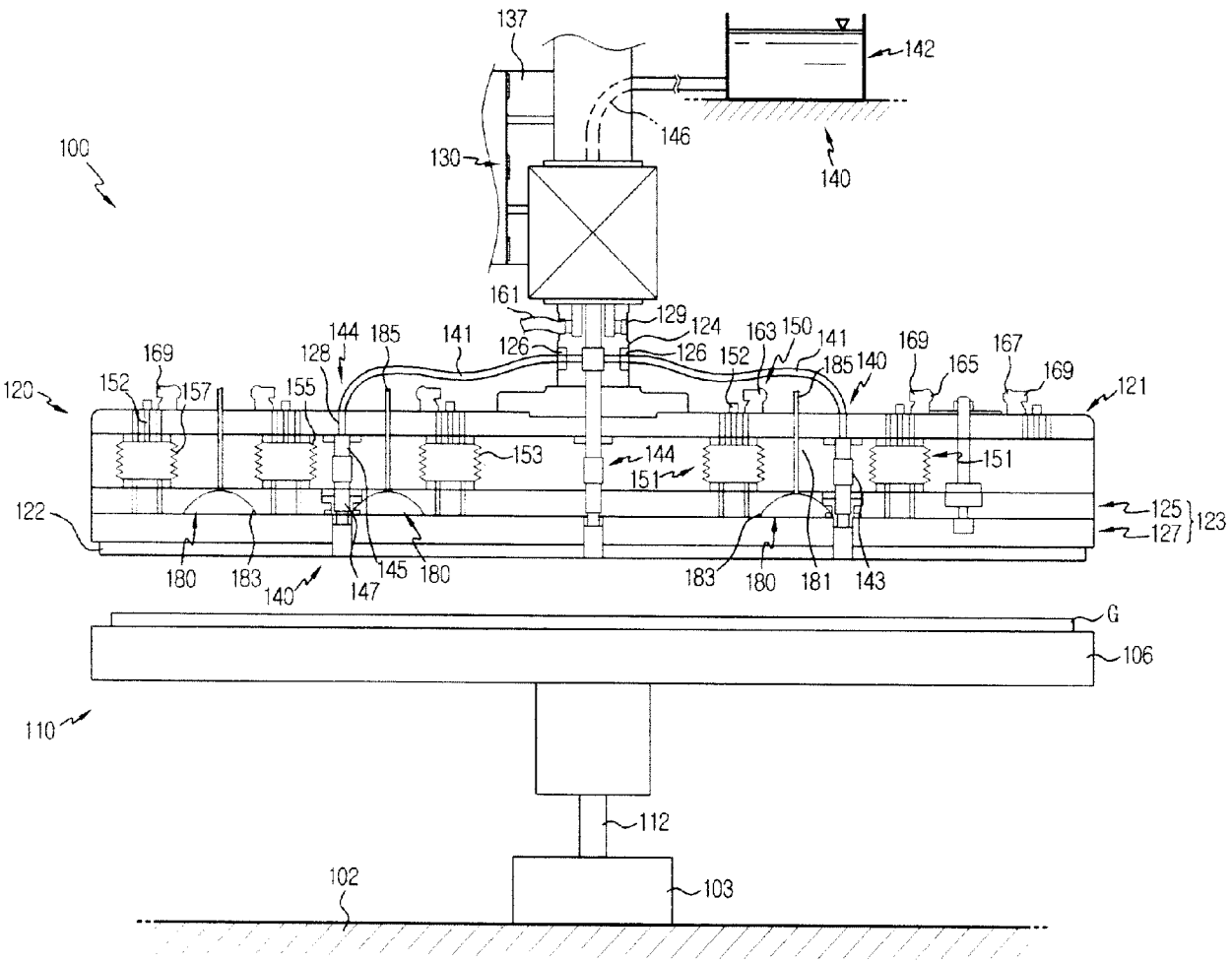
FIG. 1 is a schematic view showing a glass polishing system according to a preferred embodiment of the present invention.

FIG. 1 is a schematic view showing a glass polishing system according to a preferred embodiment of the present invention.

Referring to FIG. 1, a glass polishing system 100 according to the present invention is used for polishing one surface of a large glass G with a length of 1,000 mm or more and a thickness of about 0.3 mm to 1.1 mm to have a flatness necessary for a liquid crystal display, as an example. Also, the glass polishing system 100 includes a lower unit 110 capable of rotating a glass G, fixed thereon by absorption, at a predetermined rate, an upper unit 120 installed above the lower unit 110 and having a polishing pad 122 attached thereto such that the polishing pad 122 is contactable with an upper surface (or, a surface to be polished) of the glass G held to the lower unit 110, a moving unit 130 for moving the upper unit 120 in a horizontal or vertical direction, and a polishing slurry supply unit 140 for supplying a polishing slurry from a polishing slurry supply part 142 through the upper unit 120 to the surface of the glass G to be polished.

In the glass polishing system 100 of this embodiment, dimensions (a diameter in case of a disk shape) of the upper unit 120 and/or the polishing pad 122 attached thereto are smaller than dimensions (a smaller one between horizontal and vertical lengths) of the rectangular glass G to be polished. Also, a rotary shaft 112 of the lower unit 110 is preferably not located in a straight line with a spindle 124 of the upper unit 120 but offset from and relatively movable with respect to the spindle 124 of the upper unit 120.

In the glass polishing system 100 of this embodiment, if the lower unit 110 is rotated and at the same time the moving unit 130 is moved in a horizontal direction along a predetermined trajectory while the polishing pad 122 is contacted with the surface of the glass G to be polished, the entire surface of the glass G is uniformly polished by means of a polishing slurry supplied from the polishing slurry supply unit 140 while the upper unit 120 is passively rotated due to the rotation of the lower unit 110.

In the glass polishing system 100 of this embodiment, the moving unit 130 includes a first stage (not shown) installed to a frame 102, which supports the lower unit 110, and freely movable through an X-guide (not shown) installed in an X-direction on the frame 102 by means of a first drive source (not shown), a second stage (not shown) freely movable through a Y-guide (not shown) installed in a Y-direction on the first stage by means of a second drive source (not shown), and a third stage 137 movable in a vertical direction on the second stage by means of a third drive source (not shown) and to which the upper unit 120 is installed.

The lower unit 110 includes a rotary shaft 112 extended from a table 106 installed to the frame 102, and a fourth drive source 103 for rotating the rotary shaft 112 at a predetermined rate.

The upper unit 120 is attached to a lower end of the spindle 124 vertically extended down from the third stage 137. The spindle 124 is freely rotatable with respect to the third stage 137.

The upper unit 120 includes a fixed platter 121 and a polishing platter 123, respectively having a disk shape as a whole. Also, the polishing platter 123 is classified into a middle platter 125 and a separative platter 127. The fixed platter 121 is fixed at a lower end of the spindle 124, and the polishing platter 123 is arranged spaced apart from the fixed platter 121 to be floatable or movable with respect to the fixed platter 121. The separative platter 127 may be selectively detachably installed to the middle platter 125 in an absorption manner.

The polishing slurry supply unit 140 includes a plurality of polishing slurry supply paths 144 formed through the fixed platter 121, the middle platter 125 and the separative platter 127, respectively, so as to supply a slurry type polishing slurry containing silica particles, as an example. Also, the polishing slurry supply unit 140 includes one central supplier communicated with a central supply tube 146 formed through the spindle 124 and passing through the upper unit 120 located below the spindle 124, and a plurality of radial suppliers arranged in a radial direction based on the central supplier. In this way, the polishing slurry supplied from the polishing slurry supply part 142 is supplied to a center of the upper unit 120, or a point right below the spindle, and to plural points formed at a predetermined radius based on the spindle 124.

Each of the polishing slurry supply paths 144 includes a first path 141 and a second path 143. The first path 141 connects from the polishing slurry supply part 142 to a top of the fixed platter 121 and includes paths formed in a rotary joint (not shown). Also, the first path 141 is used for connecting a first outlet port 126 installed at a side of the spindle 124 to a first inlet port 128 installed at a top surface of the fixed platter 121, and the first path 141 preferably includes a flexible hose, a tube, a pipe or the like. The second path 143 connects from an end of the first path 141 to a lower surface of the separative platter 127. In particular, the lower surface of the fixed platter and the upper surface of the middle platter 125 are preferably made of an extendable or shrinkable structure or material. For this purpose, the second path 143 includes a first connection pipe 145 installed at the lower surface of the fixed platter 121 and a second connection pipe 147 installed at the upper surface of the middle platter 125. The first connection pipe 145 and the second connection pipe 147 may be relatively moved with respect to each other, and their connection portion is sealed. An interval between the middle platter 125 and the fixed platter 121 is adjustable. In this reason, the length of the first and second connection pipes 145, 147 may be elongated or shortened in correspondence with the movement of the polishing platter 123 with respect to the fixed platter 121.

In another embodiment, the glass polishing system 100 includes a pressing member 150 for uniformly keeping pressures at every portion of the upper unit 120 contacting with a rotating glass G. The pressing member 150 is used for making the polishing platter 123 with the polishing pad 122 installed thereto press several portions of the glass G at a substantially uniform pressure. The pressing member 150 includes a plurality of air springs 151 installed between the fixed platter 121 and the middle platter 125 of the polishing platter 123 and arranged in a predetermine pattern.

The air springs 151 are arranged to include a first air spring group 153, a second air spring group 155 and a third air spring group 157, concentrically arranged with a predetermined gap from an inner side to an outer side based on the spindle 124. Individual air springs 151 included in each air spring group 153, 155, 157 are respectively connected to a first air supply tube 163, a second air supply tube 165 and a third air supply tube 167, concentrically arranged on the upper surface of the fixed platter 121 from an inner side to an outer side based on the spindle 124. The air supply tubes 163, 165, 167 are respectively communicated through the above rotary joint (not shown) with air supply hoses 161 connected to corresponding air supply ports 129 installed at the side of the spindle 124. Also, the air supply tubes 163, 165, 167 are respectively connected to corresponding air springs 151 through sub paths 169. Each air supply tube 163, 165, 167 is preferably kept at the same pressure. In another embodiment, however, in case the pressure applied to the air springs 151 needs to be gradually increased as being distanced from the spindle 124 in a radial direction, it is also possible that the air supply tubes 163, 165, 167 are respectively set and controlled to different pressures.

The first air spring group 153 is arranged closest to the spindle 124, or on an innermost circle based on the spindle 124, and the second air spring group 155 and the third air spring group 157 are arranged at a middle circle and an outermost circle based on the spindle 124, respectively. It would be obvious to those having ordinary skill in the art that the number of concentric circles of such air springs 151 and their arrangement may be changed as desired in accordance with a size of a glass G to be polished or sizes of the lower unit 110 and the upper unit 120. As shown in FIG. 1, the second paths 143 of the polishing slurry supply unit 140 are provided to be located between the circle formed by the first air springs 153 and the circle formed by the second air springs 155.

Figure 2:
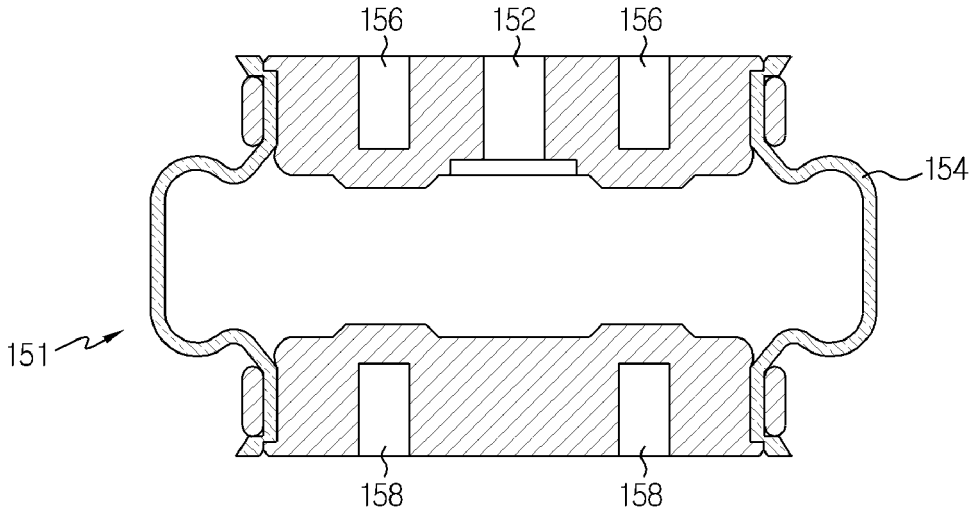
FIG. 2 is a sectional view showing an air spring adopted in the polishing system, taken from FIG. 1.
Figure 3:
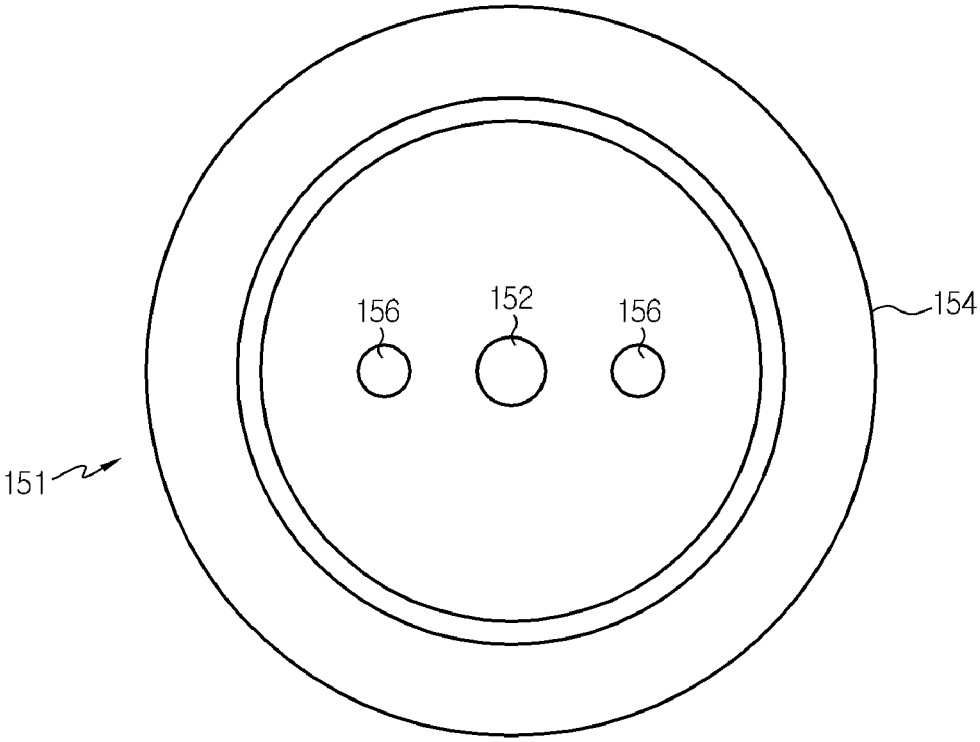
FIG. 3 is a plane view of FIG. 2.

FIG. 2 is a sectional view showing one air spring according to a preferred embodiment of the present invention, and FIG. 3 is a plane view of FIG. 2.

Referring to FIGS. 1 to 3, each air spring 151 includes a disk-type bellows having an air inlet 152 for introducing air through the fixed platter 121 and a shrinkable wall 154. Each air spring 151 includes at least one pair of upper coupling holes 156 provided at a top thereof for coupling with bolts provided through the fixed platter 121, and at least one lower coupling hole 158 provided at a bottom thereof for coupling with bolts provided through the middle platter 125. The air inlet 152 of the air spring 151 is communicated with the sub path 169, respectively, passing through the fixed platter 121. Thus, if an air is introduced through the air inlet 152, the wall 154 of the bellows of the air spring 151 is expanded to increase pressure at each region of the polishing platter 123 to which the air spring 151 is installed. In this way, the pressures applied to the glass G at the above regions may be kept uniformly rather than the other regions. Meanwhile, the air spring 151 is not limited to the bellows structure mentioned above, but it would be obvious to those having ordinary skill in the art that the air spring 151 may have any structure having identical or similar functions, already known or to be known.

Figure 4:
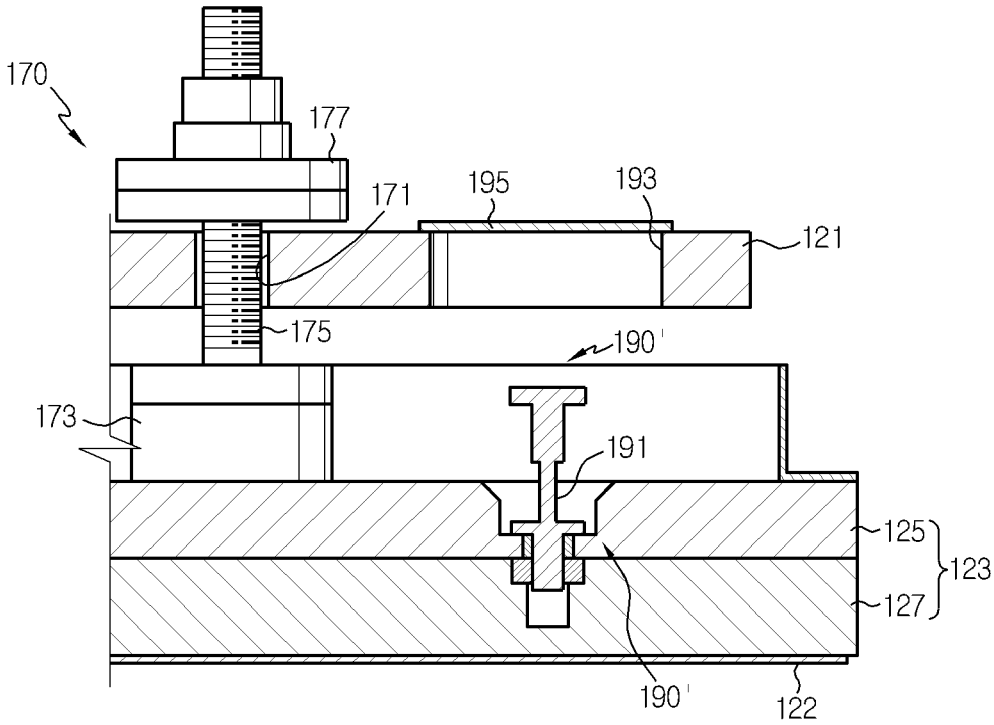
FIG. 4 is a sectional view showing an upper unit of the polishing system according to a preferred embodiment of the present invention.

FIG. 4 is a sectional view showing the upper unit of the polishing system according to a preferred embodiment of the present invention.

Referring to FIGS. 1 and 4, the glass polishing system 100 according to the preferred embodiment of the present invention includes a plurality of guide members 170 installed between the fixed platter 121 and the polishing platter 123 so as to guide the movement of the polishing platter 123 with respect to the fixed platter 121. When the polishing platter 123 is moved with respect to the fixed platter 121 due to the expansion or shrinkage of the air spring 151, the guide members 170 just allow the polishing platter 123 to be moved only in a vertical direction with respect to the fixed platter 121 and prevents the polishing platter 123 from being distorted in a horizontal direction. The guide members 170 include a guide shaft 175 fixed to a guide support 173 installed to the polishing platter 123 through a guide hole 171, and a guide stopper 177 installed at the other end of the guide shaft 175. Here, a thread is formed at one end of the guide shaft 175 so as to change the location of the stopper 177 with respect to the guide shaft 175, and the stopper 177 is preferably movably coupled to the thread of the guide shaft 175.

Referring to FIG. 1, the glass polishing system 100 according to the preferred embodiment of the present invention includes a vacuum chuck 180 for selectively compressing or separating the separative platter 127 to/from the middle platter 125.

The vacuum chuck 180 is used for facilitating maintenance or exchange of the polishing pad 122. In other words, the vacuum chuck 180 allows easy separation of the separative platter 127 from the middle platter 125 so as to avoid any trouble of separating the entire upper unit 120 from the spindle 124 of the third stage 137 for the purpose of maintenance or exchange of the polishing pad 122. In other words, the vacuum chuck 180 may compress the separative platter 127 during a polishing work so as to fix the separative platter 127 to the middle platter 125. Also, if necessary, the vacuum chuck 180 may release the vacuum to separate the separative platter 127 from the middle platter 125.

The vacuum chuck 180 includes a plurality of compressing channels (e.g., compressing tubes or pipes) 181 installed through the fixed platter 121 and the middle platter 125, and a vacuum unit 183 capable of forming a vacuum on a lower surface of the middle platter 125 contacting with the separative platter 127 so as to be communicated with the compressing channels 181. The vacuum chuck 180 includes two vacuum-forming compressing hoses 185 installed at the upper surface of the fixed platter 121 to be concentrically arranged around the spindle 124 and communicated with corresponding compressing channels 181, respectively. Each compressing channel 181 and each compressing hose 185 are respectively disposed between the first air supply tube 163 and the second air supply tube 165 and between the second air supply tube 165 and the third air supply tube 167. Each compressing channel 181 is preferably sufficiently elongated or made of flexible material in consideration of the movement of the polishing platter 123 with respect to the fixed platter 121.

In addition, the vacuum unit 183 includes a plurality of flared vacuum grooves formed in the lower surface of the middle platter 125 such that their sizes are increased from the end of each compressing channel 181. In other words, if a vacuum drive source (not shown) is operated to suck in an air through the compressing hose 185, the air in the inner space of each flared vacuum groove is driven out through the compressing channel 181 to form a vacuum in the flared vacuum grooves, thereby closely adhering and fixing the separative platter 127 to the middle platter 125.

Figure 5:
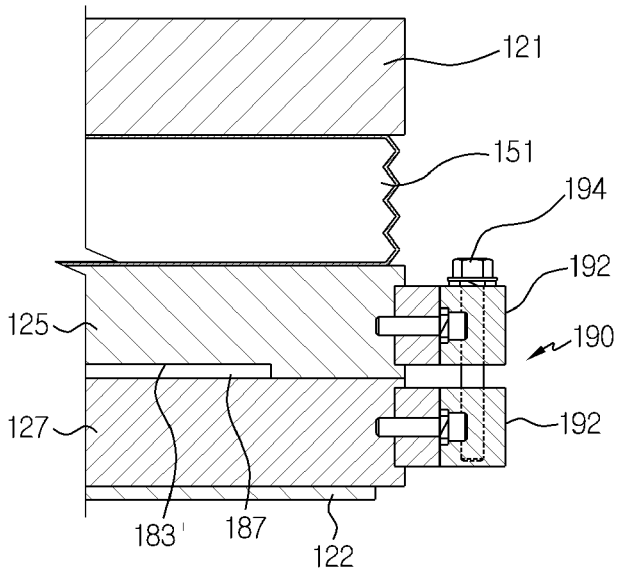
FIG. 5 is a sectional view showing a modification of a vacuum portion of a vacuum chuck of the polishing system according to the present invention.

FIG. 5 is a sectional view showing a modification of the vacuum unit of the vacuum chuck according to the preferred embodiment of the present invention.

Referring to FIG. 5, the vacuum unit 183' of this embodiment includes a stepped surface 187 formed by depressing the lower surface of the middle platter 125. The vacuum unit 183' is a modification of the vacuum unit 183 of the flared vacuum groove of the former embodiment, and the vacuum unit 183' is used for compressing or separating the separative platter 127 to/from the middle platter 125 by means of one stepped surface 187 communicated with each compressing channel 181.

The glass polishing system 100 according to the preferred embodiment of the present invention further includes a safety coupling member 190 for secondarily detachably attaching the separative platter 127 to the middle platter 125 for the preparation against an unintended accident. The safety coupling member 190 is a kind of safety device for preventing the separative platter 127 from being separated from the middle platter 125 when the vacuum chuck 180 is not operated while the glass polishing system 100 is in operation.

The safety coupling member 190 includes four coupling brackets 192 respectively protruded from rims of the middle platter 125 and the separative platter 127 and contacted with each other, and locking bolts 194 capable of being locked to locking grooves of the coupling brackets 192.

As an alternative embodiment, as shown in FIG. 4, the safety coupling member 190' includes a plurality of coupling bolts 191 capable of being fixed to the separative platter 127 through the middle platter 125. In this case, working holes 193 are formed in the fixed platter 121 at locations corresponding to the coupling bolts 191, and each working hole 193 may be opened or closed by means of a cover 195. The covers 195 may be fixed to an upper surface of the fixed platter 121 by means of cover bolts (not shown). In other words, in this embodiment, in order to separate the separative platter 127 from the fixed platter 121, it is required to release the cover bolts, open the covers 195 from the fixed platter 121, and then release the coupling bolts 191 through the working holes 193.

Now, operations of the glass polishing system according to the preferred embodiment of the present invention, configured as above, will be explained.

First, a glass G to be polished is attached to an upper surface of the lower unit 110 in a known way such as absorption, and then the fourth drive source 103 is operated to rotate the table 106. Meanwhile, the third drive source is operated to move the third stage 137 downward such that the lower surface of the polishing pad 122 of the upper unit 120 is compressed to a surface of the glass G to be polished. Also, if the first and second drive sources are operated, the first and second stages are moved respectively on a horizontal plane along predetermined trajectories. Then, the upper unit 120 is passively rotated due to the rotation of the lower unit 110, and at the same time the upper unit 120 is rotated based on the spindle 124 due to the movement of the first and second stages.

If the polishing slurry supply unit 140 is operated in this process, the polishing slurry stored in the polishing slurry supply part 142 is supplied through the central supplier and the radial suppliers arranged around the central supplier in a radial direction along the polishing slurry supply paths 144 respectively formed through the fixed platter 121, the middle platter 125 and the separative platter 127, so the polishing slurry is uniformly applied to the surface of the glass G to be polished. It is possible to set that the polishing slurry supply unit 140 supplies a polishing slurry successively during the entire polishing time, and the used polishing slurry may be filtered and then retrieved to the polishing slurry supply part 142 for circulation.

Then, the upper unit 120 is rotated based on the spindle 124 while being eccentric based on the rotary shaft 112 of the lower unit 110, so the pressing member 150 is operated to uniformly keep the pressure applied to the entire region of the glass G from every portion of the upper unit 120.

If the pressing member 150 is operated, an air supply source (not shown) supplies an air through a path in the rotary joint and the spindle 124, and the air is supplied through each air supply tube 163, 165, 167 to corresponding first, second and third air spring groups 153, 155, 157 to expand the wall 154 of the bellows of each air spring 151. Then, the location of the polishing platter 123 with respect to the fixed platter 121 is changed, and the pressure at every air spring 151 becomes uniform, so it is possible to always keep the pressure uniformly on the surface of the glass G to be polished through the upper unit 120 is moved on a horizontal plane due to the moving unit 130.

Here, the pressing member 150 may be operated before the polishing pad 122 of the upper unit 120 contacts with the surface of the glass G to be polished, or when the polishing process is initiated after the polishing pad 122 contacts with the glass G. Meanwhile, the pressing operation of the pressing member 150 may be controlled according to a set pressure during the polishing process.

Meanwhile, if the vacuum chuck 180 is operated before the polishing process is initiated, the separative platter 127 of the polishing platter 123 is fixed to the middle platter 125. If the vacuum chuck 180 is operated, the vacuum drive source (not shown) is operated to form a vacuum at the vacuum unit 183 having a flared vacuum groove shape or the vacuum unit 183' having the stepped surface 187 through the compressing hose 185, so the separative platter 127 may be attached by absorption to the middle platter 125. The separative platter 127 is also stably fixed to the middle platter 125 by means of the safety coupling member 190.

Hereinafter, a method for polishing a glass according to a preferred embodiment of the present invention is explained.

In the process of polishing a glass G, the method for polishing a glass according to this embodiment includes at least one of: pressing the polishing platter 123 by using a plurality of air springs 151 installed between the fixed platter 121 and the polishing platter 123 so as to uniformly keep the pressure applied to the glass G at a plurality of portions of the upper unit 120; supplying a polishing slurry to a surface of the glass G through the polishing slurry supply paths 144 respectively formed through the fixed platter 121, the middle platter 125 and the separative platter 127; and fixing the separative platter 127 with respect to the middle platter 125.

Thus, according to the method for polishing a glass of this embodiment, it is possible to stably supply a polishing slurry to a surface of a glass G to be polished, to keep the flatness of the glass G to a desirable level by means of the air springs 151, and to stably keep the separative platter 127 with respect to the middle platter 125. Thus, it is possible to improve precision and yield of the glass polishing process. It allows minimizing an inferiority rate in the glass polishing process.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A glass polishing system, comprising:

a lower unit capable of rotating a glass placed at a fixed position;

an upper unit capable of contacting with the glass and being passively rotated due to the rotation of the glass; and a moving unit for moving the upper unit in a horizontal and/or vertical direction, wherein the upper unit includes:

a platter installed to a spindle of the moving unit;

a separative platter separatably installed to the platter and having a polishing pad contacting with the glass; and a vacuum chuck for fixing the separative platter with respect to the platter by means of vacuum.

2. The glass polishing system according to claim 1, wherein the vacuum chuck includes:

a plurality of compressing channels installed through the fixed platter and the platter; and a vacuum unit for forming a vacuum on a surface of the platter, contacted with the separative platter, so as to be communicated with the compressing channels.

3. The glass polishing system according to claim 2, wherein there are provided at least two vacuum chucks concentrically arranged based on the spindle.

4. The glass polishing system according to claim 2, wherein the vacuum unit includes an integrated stepped surface formed by depressing a lower surface of the platter.

5. The glass polishing system according to claim 2, wherein the vacuum unit includes a plurality of flared vacuum grooves formed in a lower surface of the platter such that the grooves have an increased size from the compressing channels.

6. The glass polishing system according to claim 5, wherein the safety coupling member includes a plurality of brackets provided at rims of the platter and the separative platter, and a locking unit for locking the brackets.

7. The glass polishing system according to claim 6, wherein the safety coupling member includes a plurality of coupling bolts fixed to the separative platter through the platter.

8. The glass polishing system according to claim 7, further comprising:

covers for covering the coupling bolts, respectively.

9. The glass polishing system according to claim 8, wherein the polishing slurry supply unit includes a plurality of polishing slurry supply paths installed through the platter and the separative platter.

10. The glass polishing system according to claim 1, further comprising:

a safety coupling member for detachably attaching the separative platter to the platter.

11. The glass polishing system according to claim 1, wherein the platter includes:

a fixed patter fixed to the spindle;

a middle platter installed movably with respect to the fixed platter, the separative platter being attached to the middle platter, and a pressing member interposed between the fixed platter and the middle platter to keep a uniformity of pressure of the upper unit, applied to the glass.

12. The glass polishing system according to claim 11, wherein the pressing member includes a plurality of air springs installed between the fixed platter and the middle platter.

13. The glass polishing system according to claim 12, wherein the air springs include at least one air spring group arranged in a circular pattern based on the spindle.

14. The glass polishing system according to claim 13, wherein every air spring included in the same air spring group is kept at the same pressure.

15. The glass polishing system according to claim 12, wherein each of the air springs includes a bellows with an air inlet so as to suck in an air supplied through the fixed platter.

16. The glass polishing system according to claim 11, further comprising:

a plurality of guide members installed between the fixed platter and the middle platter so as to guide the movement of the middle platter with respect to the fixed platter.

17. The glass polishing system according to claim 16, wherein each of the guide members includes:

a guide shaft installed to the middle platter through the fixed platter; and a guide stopper installed at the other end of the guide shaft.

18. The glass polishing system according to claim 1, further comprising:

a polishing slurry supply unit for supplying a polishing slurry to the glass through the platter and the separative platter.

* * * * *